US005738383A

United States Patent [19]

Main et al.

[11] Patent Number: 5,738,383

[45] Date of Patent: Apr. 14, 1998

[54] LABEL ASSEMBLY WITH PATTERNED ADHESIVE BANDS

[75] Inventors: George W. Main, Essex Junction; Jean Claude LaLande, Colchester, both of Vt.

[73] Assignee: KoBel, Inc., Milton, Vt.

[21] Appl. No.: 752,784

[22] Filed: Nov. 20, 1996

[51] Int. Cl.[6] ..... B42D 15/00

[52] U.S. Cl. ..... 283/81; 283/101

[58] Field of Search ..... 283/81, 101, 80, 283/79; 428/40.1, 42.1, 343, 906

[56] References Cited

U.S. PATENT DOCUMENTS

| | | | |
|---|---|---|---|
| 2,292,024 | 8/1942 | Dreher | 428/42.1 |
| 2,836,290 | 5/1958 | Braun | 283/81 |
| 4,772,499 | 9/1988 | Greenway | 428/42.1 |
| 5,312,680 | 5/1994 | Simpson | 428/40.1 |
| 5,370,916 | 12/1994 | Olsen | 428/40.1 |

*Primary Examiner*—Willmon Fridie, Jr.
*Attorney, Agent, or Firm*—Thomas N. Neiman

[57] ABSTRACT

The label assembly with patterned adhesive bands is designed to provide a label which permits the cutting of the labels in a manner which will keep the cutting device free from adhesive or other materials that would foul up and jam the cutting device itself. The label assembly consists of a strip of material upon which the front side is printed upon. The rear side of the strip has an application of adhesive which results in a strip without any adhesive between each label or a pattern of alternating adhesive and non adhesive bands. No back liner is provided. The label assembly is used in creating a label on demand in conjunction with scales for meat, poultry and fish among other items.

5 Claims, 1 Drawing Sheet

LABEL ASSEMBLY WITH PATTERNED ADHESIVE BANDS

BACKGROUND OF THE INVENTION

This invention pertains to label type devices, and in particular, to such a label assembly with patterned adhesive bands that are designed to use a screened application of adhesive which results in a strip of non adhesive between each label and allows the cutting of those labels without the gumming up of the cutting implement or the dispensing thereof.

Many types and designs of labels are currently on the market. There have been many of these devices that have been patented. Examples of these devices include the U.S. Pat. No. 5,383,686 to David F. Laurash for a Label For Operational Control System which issued on 24 Jan. 1995, the U.S. Pat. issued to Rollin T. White, No. 4,128,954 for a Packing Label Manufacture of Same issued on 12 Dec. 1978. These devices show different approaches in labels and form assemblies which, in general require that the label have backing liners and continuous use of adhesives which creates a problem when designing these labels for use in creating labels on demand and when cutting the labels with standard cutting implements. What is needed is a linerless label that an individual can easily cut or dispense on current cutting equipment and limit the number of foulings due to the gumming up of the cutting equipment.

Clearly, it is desirable for a device of this type to be very adaptable. At the same time, the device should be easy to manufacture and be produced of inexpensive material. It is the object of this invention to teach a label assembly which will increase the numbers of labels per roll by creating a self wound roll. It is the object of this invention to set forth a label assembly with patterned adhesive bands which avoids the disadvantages, previously mentioned limitations of typical label assemblies.

SUMMARY OF THE INVENTION

Particularly, it is the object of this invention to teach a label assembly with patterned adhesive bands, for use in creating a label on demand to allow for cutting or dispensing of the label after printing without fouling the cutting implement, comprising a single sheet of material; said single sheet of material having a first side and a second side, the first side having printable areas for printing of labels; said second side of said single sheet of construction having an adhesive coating located thereon; and said adhesive coating comprising first means of a strip of adhesive coating and second means of a strip having no adhesive coating, said first means and said second means comprising an alternating pattern of adhesive coating and plain material.

BRIEF DESCRIPTION OF THE INVENTION

Further objects and features of this invention will become more apparent by reference to the following description taken in conjunction with the following figures, in which.

DESCRIPTION OF THE PREFERRED EMBODIMENTS

Figure 1:
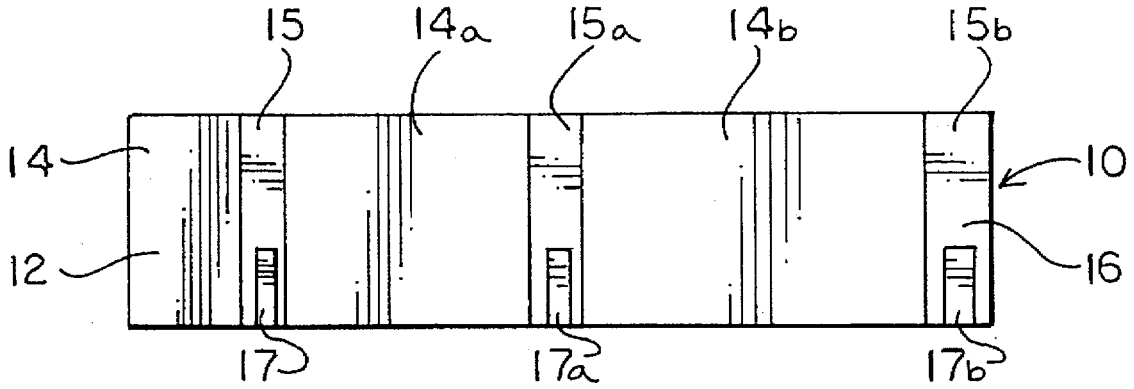
FIG. 1 is a rear elevational view of the novel label with patterned adhesive bands.
Figure 2:
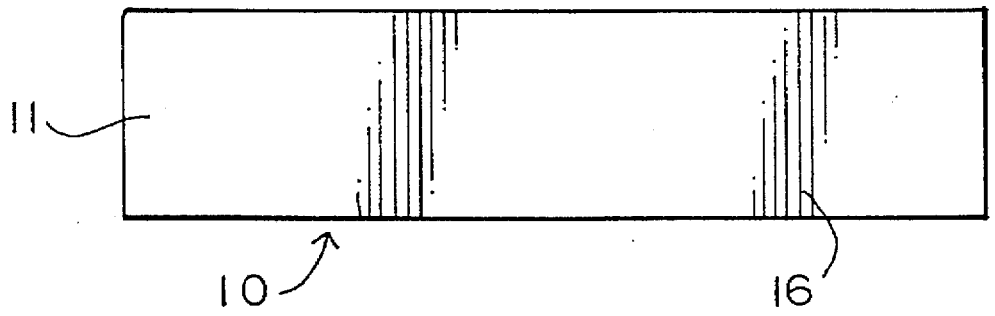
FIG. 2 is a front elevational view thereof.
Figure 3:
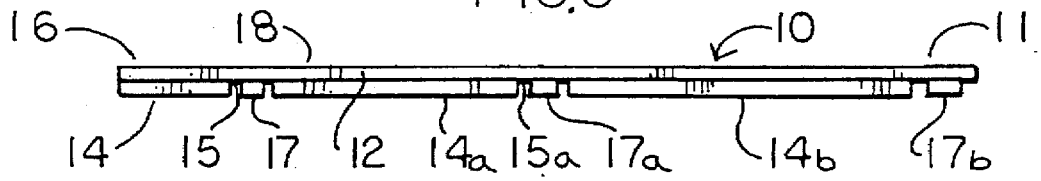
FIG. 3 is a cross sectional view taken along line 3—3 of FIG. 2.

As shown in the figures, the novel label assembly 10 with patterned adhesive bands comprises a single strip of material 16 that has a first or front side 11 upon which the label is printed. The single strip of material can be constructed of cellulose or plastic film materials and the printed side is coated with a release agent. The strip of material 16 has a second or rear side 12 upon which separate patches 14, **14*a* and 14*b* of adhesive are positioned by means of a screened or layered application of the adhesive. This application process allows for intermittent areas 15, 15*a* and 15*b* of the rear side to have no adhesive. Those areas are designed to be between each of the printed labels on the front side 11 of the single strip 16. Markers 17, 17*a* and 17*b* are printed in the areas having no adhesive in order to provide a machine reader the ability to determine the position to cut the sheet 10 to create individual labels. This is done so that the label assembly 10 can be cut after it is printed and the cutting implement will not become fouled with an adhesive such as glue, which is currently the standard procedure at this time. The label assembly 10 can also be rolled into a self wound roll which increases the number of labels per roll. The intermittent areas 15, 15*a* and 15*b* are plain material. The label assembly 10** is designed not to have any backing which is costly and wastes material. This type label assembly is to be used as labels that are used with scales in the measurement of meat, fish and poultry among other items.

While we have described our invention in connection with specific embodiments thereof, it is clearly to be understood that this is done only by way of example and not as a limitation to the scope of our invention as set forth in the objects thereof and in the appended claims.

We claim:

1. A label assembly with patterned adhesive bands, for use in creating a label on demand to allow for cutting of the label after printing or dispensing without fouling the cutting implement, comprising:

a single sheet of material;

said single sheet of material having a first side and a second side, the first side having a printable areas for printing of labels;

said second side of said single sheet of material having a permanent adhesive coating located thereon;

said second side of said single sheet of material further having indicator means for identifying the areas having the adhesive coating for permitting the machinery to accurately identify those areas; and said permanent adhesive coating comprising first means of a strip of permanent adhesive coating and second means of a strip having no adhesive coating, said first means and said second means comprising an alternating pattern of adhesive coating and material having a perimeter containing no permanent adhesive coating.

2. A label assembly with patterned adhesive bands, according to claims 1, wherein:

said first side of said single sheet of material having a coating on said first side of said single sheet of material; and said coating on said first side of said single sheet of material comprises a layer of release agent.

3. A label assembly with patterned adhesive bands, according to claim 1, wherein:

said single sheet of material comprises a document without a back liner.

4. A label assembly with patterned adhesive bands, according to claim 1, wherein:

said indicator means comprises markers printed on said second side of said single sheet of material for permitting machine reading of the proper position for the cutting of said label assembly.

5. A label assembly with patterned adhesive bands, according to claim 1, wherein:

said alternating pattern of permanent adhesive coating and screened applications comprises a pre-determined selection of various screened applications for maintaining said permanent adhesive coating away from said plain material for facilitating ease of cutting.

* * * * *